US006561754B1

(12) United States Patent
Schwarz

(10) Patent No.: US 6,561,754 B1
(45) Date of Patent: May 13, 2003

(54) INLET STRUCTURE FOR PUMP INSTALLATIONS

(75) Inventor: Gerhard Schwarz, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 09/743,032

(22) PCT Filed: Jun. 19, 1999

(86) PCT No.: PCT/EP99/04265

§ 371 (c)(1),
(2), (4) Date: Jan. 4, 2001

(87) PCT Pub. No.: WO00/01951

PCT Pub. Date: Jan. 13, 2000

(30) Foreign Application Priority Data

Jul. 6, 1998 (DE) ..... 198 30 185

(51) Int. Cl.[7] ..... F04D 29/52; F04D 29/60
(52) U.S. Cl. ..... 415/88; 415/213.1
(58) Field of Search ..... 415/213.1, 88–184, 415/191, 205, 208.1, 200

(56) References Cited

U.S. PATENT DOCUMENTS 1,476,210 A 12/1923 Moody
1,712,184 A * 5/1929 Wendel ..... 415/88
3,859,008 A * 1/1975 Wieser ..... 415/209.1
4,143,999 A * 3/1979 Ryall ..... 415/88

FOREIGN PATENT DOCUMENTS

| | | | |
|---|---|---|---|
| CH | 552 139 | | 7/1974 |
| DE | 403 986 | | 10/1924 |
| DE | 21 37 637 | | 2/1973 |
| DE | 25 55 253 | | 6/1977 |
| DE | 37 10 452 | | 10/1988 |
| EP | 0 459 034 | | 12/1991 |
| GB | 1 385 715 | | 2/1975 |
| JP | 53089002 A | * | 8/1978 |
| JP | 62107299 A | * | 5/1987 |
| JP | 64000392 A | * | 1/1989 |

OTHER PUBLICATIONS

Migod et al., KSB Technical Reports #17, pp. 25–45 (1977).
Migod et al., KSB Technical Reports #17, pp. 40, 41, 62–65 and 150–153 (1977).

* cited by examiner

*Primary Examiner*—Edward K. Look
*Assistant Examiner*—Igor Kershteyn
(74) *Attorney, Agent, or Firm*—Crowell & Moring LLP

(57) ABSTRACT

An open or covered inlet structure having pumps arranged therein. To be able to reduce excavation and concreting works, the foundations of the inlet structure are positioned at a substantially higher level. Only at the point at which the pumps (2) and their inlet nozzles are mounted does the foundation plate have one or more recesses or depressions (7) into which the first impellers (2.1) of the pumps (2) are lowered.

10 Claims, 3 Drawing Sheets

INLET STRUCTURE FOR PUMP INSTALLATIONS

BACKGROUND OF THE INVENTION

The invention relates to an inlet structure of the covered or open type, with one or more semiaxial-throughflow or axial-throughflow pumps arranged therein, for use in power plants and/or in water conservation plants, an inlet nozzle of a pump being arranged in an inlet chamber so as to maintain ground clearance.

Such inlet structures are often used in pumping stations in which large quantities are to be conveyed. For example, in power plants or plants for the irrigation or drainage of large areas of land, such inlet structures must conform to specific conditions in order to meet the requirements placed on them. The problems of such inlet structures are described in detail in the article "Einfluß von Kühlverfahren und Zulaufbedingungen auf die Bauart von Kühlwasserpumpen fur Warmekraftwerke" ["Influence of cooling processes and inflow conditions on the design of cooling-water pumps for thermal power stations"] by A. Migod and H. Siekmann, KSB Technische Berichte [KSB Technical Reports], No. 17, 1977, pages 25 to 45.

U.S. Pat. No. 1,476,210 shows various designs of such inlet structures with pumps installed therein. It becomes clear from this that the structure costs assume great importance in the production of such stations. The costs of producing such a structure may easily exceed the actual costs of the pump.

DE-B-21 37 637 describes the hydraulic problems of inlet chambers necessarily installed in such structures. The installation of a baffle is intended to achieve an optimized inflow to the inlet nozzle of a pump. This is necessary, since, predominantly, a plurality of inlet chambers are arranged in an inlet structure. Depending on the switch-on states of the pumps and on the conditions of inflow to the inlet chambers, therefore, inflow conditions often arise which may have adverse effects on the suction behaviour.

SUMMARY OF THE INVENTION

The object of the invention is, for such inlet structures with a multiplicity of pump and inlet chambers, to achieve optimization of the structural measures, whilst at the same time improving the inflow conditions.

This problem is solved by the invention as described and claimed hereinafter.

Arranging the pump with its inlet nozzle and/or with part of its casing in the depression ensures that a first pump impeller adjacent to the inlet nozzle is arranged at a lowest point in the inlet structure. By the inlet nozzle being arranged in a depression of the floor surface of the inlet structure, the total outlay involved in constructing the latter can be decisively reduced. Excavation work and foundations for the inlet structure and the inlet chambers no longer need to have the depth which has been necessary hitherto. The same applies to inflow gutters or channels, by means of which a medium to be conveyed has been supplied to the pump. Instead, a lowest point for the structure is now provided only in the region of the inlet nozzle in a simple way at the place of installation of such a pump. Consequently, each inlet nozzle of such pumps penetrates, as it were, into a pit, the upper edge of which is at the same the lower edge of a basin or channel delivering the medium to be conveyed.

Arranging the pump inlet nozzle in such a depression affords the additional advantage of improved conditions of inflow to the first impeller of such a pump. The turbulences prevailing in conventional inlet structures on account of the multiplicity of channels, inlet chambers and branches are compensated by the directional inflow between the depression and the pump part located therein.

Since the medium to be conveyed is guided more effectively as a result of inflow between the wall surface of the depression or of the pit and the pump part located therein, the inflow conditions which present problems in the known inlet chambers are compensated.

Furthermore, pumps of smaller diameter with higher rotational speeds can be used. The higher NPSH necessary for this purpose is provided in the simplest possible way by the cost-effective production of the local depression, as a result of which the costs for the pump and drive and also the structure costs are ultimately reduced by a multiple.

In one embodiment of the invention, the pump is of the single-stage or multi-stage type. It is consequently possible in a simple way to adapt to the respective plants and their conveying conditions. The inflow cross section between the depression and the pump part, with the inlet nozzle, located therein and the length of the depression are dimensioned such that the pump can be operated without cavitation and, with a view to high efficiency, the losses are kept as low as possible.

Single-stage spiral-casing pumps with complicated concrete spirals are often used for drainage or irrigation purposes and large quantities of cooling water. This type has a significant height difference between the entry level and exit level, but is substantially more complicated to produce. The solution according to the invention achieves the significant advantage that a metallic pump, for example a tubular-casing pump or a submersible motor-driven pump with delivery duct can be used in the same field as spiral-casing pumps in the simplest possible way with very low costs in terms of construction. As a result of the simple depression, into which the suction nozzle of a first impeller is lowered, the remaining structure depth of the inlet structure can be substantially smaller. Consequently, there can be considerable saving in terms of excavation work, securing and supporting work and also concreting costs.

An additional advantage is afforded by the different design of such structures which becomes possible as a result. The spacious inlet and inflow structures which have been necessary hitherto, and also the long inflow or connecting channels having a slight descending gradient can likewise be reduced with regard to their construction volume. It is sufficient, in the respective place where a medium to be conveyed occurs, to provide the arrangement of a correspondingly low suction point for the pump, in order to convey said medium to respective intended location again with the aid of simple delivery lines.

Further embodiments of the invention provide a streamlined transition at the transition between the inlet chamber and the orifice of the depression. This avoids unfavourable vortices being generated in the event of a deflection of the flow. Also, depending on the length of the pump, the latter may be arranged in the depression so as to be freely suspended or with supporting elements being interposed. This depends on the respective installation situation and on the plant conditions.

Also, within the depression, one or more flow-guiding guide elements are arranged, with the aid of which the cavitation behaviour is influenced.

According to other refinements of the invention, the depression consists of completely or partially prefabricated structural parts. These may be finished concrete parts or prefabricated commercially available structural parts which can be used for such purposes.

BRIEF DESCRIPTION OF THE DRAWINGS

Exemplary embodiments of the invention are illustrated in the drawings and are described in more detail below.

In these.

DETAILED DESCRIPTION OF PREFERRED EMBODIMENTS

Figure 1:
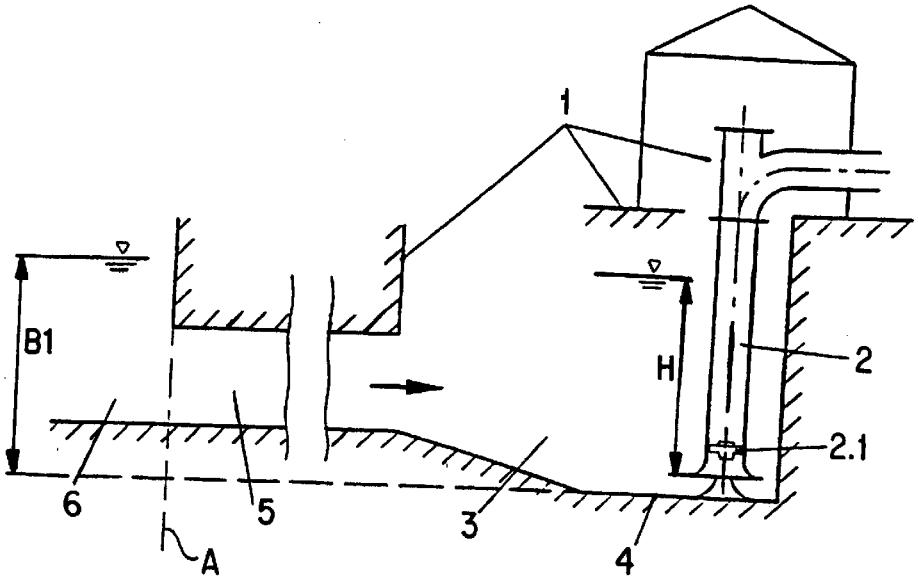
FIG. 1 PRIOR ART
FIG. 1 shows the diagrammatic make-up of a inlet structure.

FIG. 1 shows a diagrammatic illustration of an inlet structure 1, in which is arranged a pump 2 which from an inlet basin 3 extracts a medium to be conveyed. The inlet basin 3 normally forms the lowest point of the foundation 4 of the inlet structure 1 in the latter. A medium to be conveyed flows to the inlet basin or inlet chamber 3 through open or closed channels 5, and said medium to be conveyed may be extracted from a river, lake or basin 6. A reference line A, with also applies to FIG. 1 and FIG. 2, symbolizes the start of the channels 5 of the inlet structure 1. On this basis, the reduction in the overall length of the inlet structure becomes clear in FIG. 2.

In order to ensure the overlap H necessary for the reliable cavitation-free operation of the pump and also to provide the corresponding conveying quantities, the inlet basins 3 of FIG. 1 have a corresponding size and depth. This necessitates a very high outlay in terms of excavating, concreting and laying the foundation of the entire inlet structure 1 together with the associated channels 5.

Figure 2:
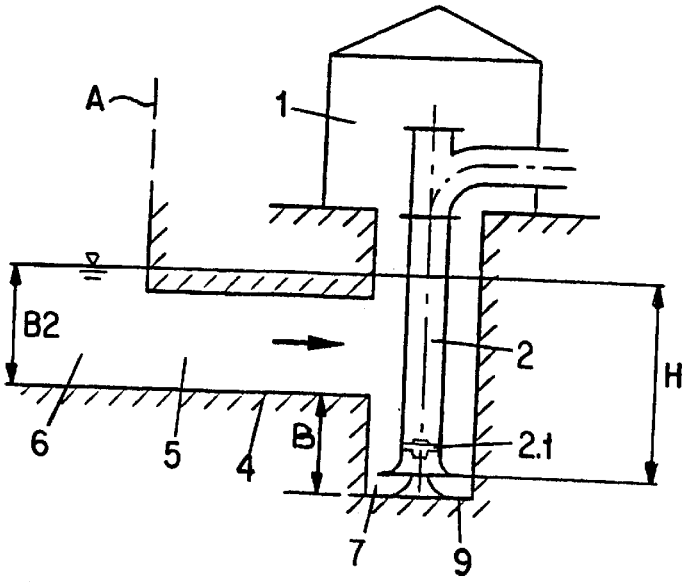
FIG. 2 shows an inlet structure with depressions for receiving pumps.

By contrast, it is evident from FIG. 2 that the inlet basin 3 for the pump 2 is made very shallow. As compared with the previous design according to FIG. 1, then, with the overlap H being the same, the foundation 4 can be arranged at a substantially lesser depth, with the result that the outlay in terms of construction becomes lower. Only in the region of a pump 2 does the inlet structure 1 have a local depression 7 for lowering the first impeller. This depression 7 which is in the form of a pit, can be constructed in a simple way during the production of an inlet structure 1. The dimensions of said depression are selected such that the inflow to the pump is not impaired.

On the basis of the lowest water level shown in FIGS. 1 and 2, the foundation depths B1 and B2 of the inlet structure 1 are illustrated. It becomes clear in FIG. 2 that the foundation depth B2 for the foundation 4 necessitates a substantially lower outlay in terms of construction work, whilst ensuring the same pump capacities. Only in the region of the place of installation of the pump is it necessary to have a local depression. The depression 7 can be produced with conventional prefabricated structural elements at very little outlay in terms of excavation and foundation laying. At the place of installation of the pump, in particular at the location of its first impeller, the local depression 7 is adapted to the pump diameter. The depression is connected in a simple way to the foundation 4 of the inlet structure 1, said foundation being at a substantially lesser depth. As compared with the known embodiments, there is no need for the outlay which has been necessary hitherto for excavating and producing the spacious inlet basins 3. A further saving in the construction outlay can be achieved by the pumps being installed nearer to the place from which the medium has to be conveyed.

Figure 3:
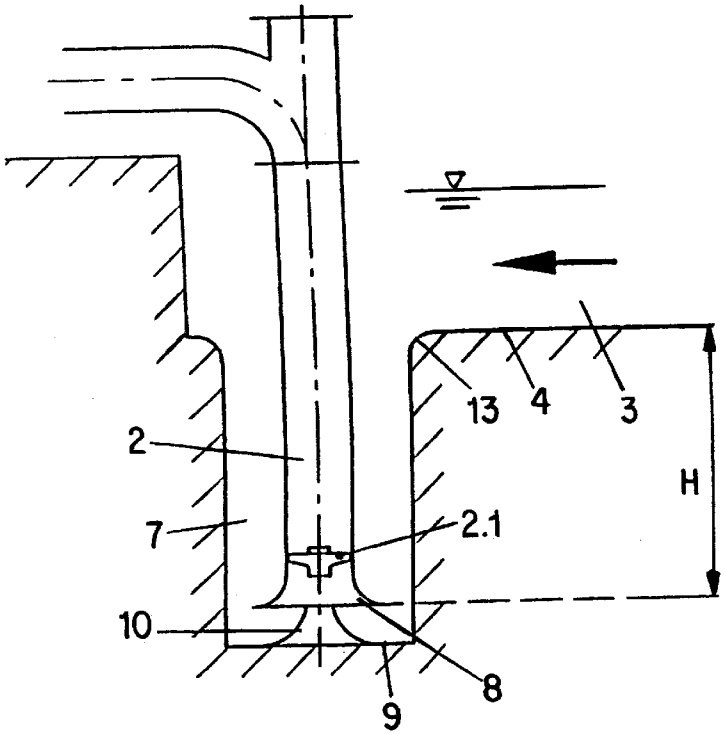

FIG. 3 shows an enlarged illustration of an inlet chamber similar to FIG. 2. Starting from the foundation 4 of a new inlet structure, said foundation being arranged substantially higher, as compared with FIG. 1, the inlet chamber 3 has a depression 7 in the region of the first impeller 2.1 of the pump 2. An inlet nozzle 8 located on the pump 2 is arranged with a clearance relative to the bottom 9 of this depression 7, said bottom having a conventional inlet cone 10 for the purpose of better flow guidance. The foundation 4 of the inlet structure 1 can therefore be arranged at a substantially high level, and a local depression 7, simple to produce, has to be excavated and concreted in each case only in the region of the first pump impellers.

Figure 4:
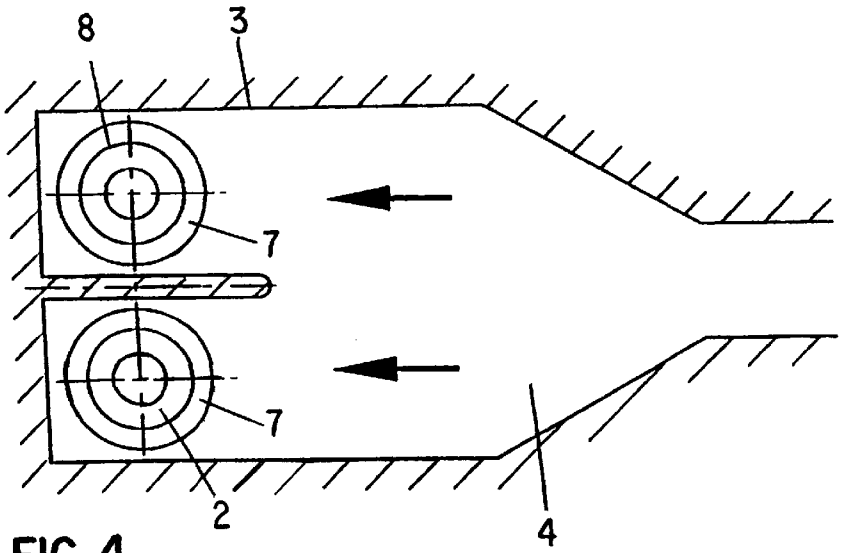
FIGS. 3–7 show various embodiments of the depression and/or pits.

FIG. 4 shows a top view of an inlet chamber according to FIG. 3. Here, two pumps 2 arranged next to one another are shown in the inlet basin 3, but more or fewer pumps may also be used. The bottom surface of the inlet chamber 3, said bottom surface lying at a higher reference level of the foundation 4, has only locally arranged depressions or pits 7 in the region of the place of installation of the pumps 2. The medium to be conveyed, illustrated with the aid of the arrows, flows into the inlet chamber 3 at a higher level and then flows into the depressions 7 from above. At the bottom of the depression, the medium to be conveyed is deflected and flows through the inlet nozzle 8 into the pump 2 and flows out in the direction opposite to the inflow direction. The choice of length of the depression 7 makes it possible to ensure the height difference which is necessary for reliable conveyance of the medium and which takes the form of the overlap H of the medium to be conveyed. Cavitation-free pump operation is thus possible in a simple way. A streamlined transition 13 is formed at the orifice of the depression 7 for the purpose of better flow guidance.

Figure 5:
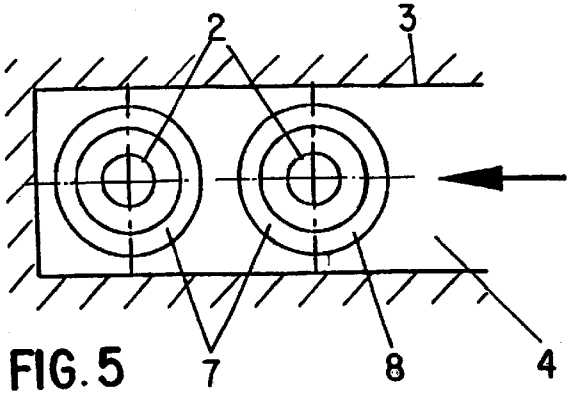

The embodiment of FIG. 5 differs from the embodiment of FIG. 4 in that, here, the pumps 2 and their associated depressions 7 are arranged one behind the other in the inflow direction of the medium to be conveyed.

Figure 6:
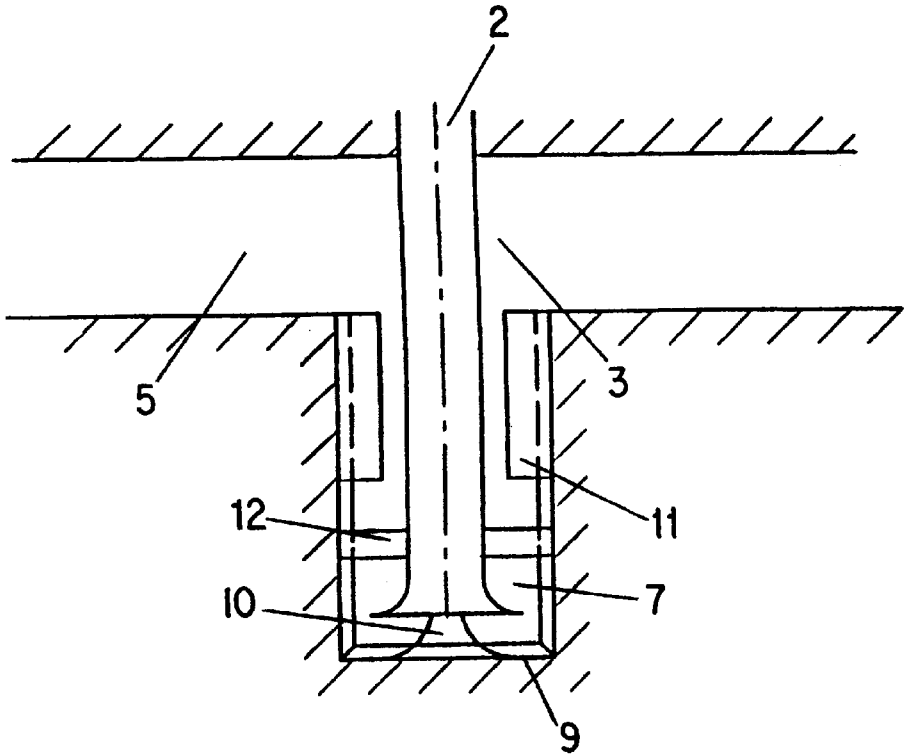

The embodiment of FIG. 6 has, as compared with the embodiment of FIG. 3, a supply channel 5 and an inlet basin 3 in a covered version. Also shown, in the depression 7, are various guide elements 10, 11, with the aid of which it is possible to influence the flow. For those installation situations in which vibrations are to be expected on account of the dimensions, the pump 2 may be supported relative to the depression 7 or to fittings 10, 11 located therein by means of supporting elements 12.

Figure 7:
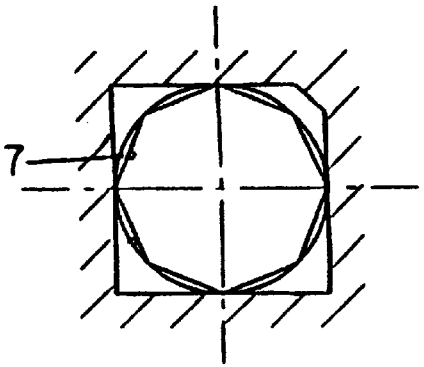

FIG. 7 shows a top view of various cross sectional shapes, arranged one in the other, of a plurality of possible depressions 7. For reasons of simple production, a cross-sectional shape will be used which can be produced in a simple way and has good flow conditions. When a square or rectangular or a round cross-sectional shape is used, if appropriate prefabricated concrete structural parts may be employed, such as are customary in pipeline construction. Such a measure likewise reduces the costs of producing an inlet structure to a considerable extent.

What is claimed is:

1. An inlet structure with at least one tubular-casing pump arranged therein having a pump inlet arranged in an inlet chamber so as to maintain a ground clearance and a first impeller arranged at a lowest inflow point, wherein a depression is arranged in a base of the inlet structure, and at least one of said pump inlet and said first impeller is arranged in said depression, wherein said inlet structure is an open inlet structure, in which liquid pressure is near atmosphere pressure.

2. An inlet structure according to claim 1, wherein said at least one tubular casing pump is a semiaxial-throughflow pump.

3. An inlet structure according to claim 1, wherein said at least one tubular casing pump is an axial-throughflow pump.

4. An inlet structure according to claim 1, wherein both said pump inlet and said first impeller are arranged in said depression.

5. An inlet structure according to claim 1, wherein a streamlined transition disposed between the inlet chamber and a mouth of the depression.

6. An inlet structure according to claims 1, further comprising at least one support element arranged between the depression and the pump inlet to support the pump.

7. An inlet structure according to claim 1, further comprising at least one flow guide element arranged in the depression.

8. An inlet structure according to claim 1, wherein the depression is at least partially formed of prefabricated structural parts.

9. An inlet structure with at least one tubular casing pump arranged therein having a pump inlet arranged in an inlet chamber so as to maintain a ground clearance and a first impeller arranged at a lowest inflow point, wherein a depression is arranged in a base of the inlet structure, and at least one of said pump inlet ad said first impeller is arranged in said depression, wherein the pump is arranged in the depression so as to be freely suspended.

10. An inlet structure according to claim 9, wherein said inlet structure is covered inlet structure.

* * * * *